US012805575B2

(12) United States Patent
Kwon et al.

(10) Patent No.: US 12,805,575 B2
(45) Date of Patent: Nov. 24, 2026

(54) AEROSOL-GENERATING DEVICE

(71) Applicant: KT&G CORPORATION, Daejeon (KR)

(72) Inventors: Young Bum Kwon, Gyeonggi-do (KR); Hun Il Lim, Seoul (KR); Dong Sung Kim, Seoul (KR); Yong Hwan Kim, Gyeonggi-do (KR); Seok Su Jang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 374 days.

(21) Appl. No.: 18/564,646

(22) PCT Filed: Nov. 9, 2022

(86) PCT No.: PCT/KR2022/017503
§ 371 (c)(1),
(2) Date: Nov. 28, 2023

(87) PCT Pub. No.: WO2023/085746
PCT Pub. Date: May 19, 2023

(65) Prior Publication Data

US 2024/0251867 A1 Aug. 1, 2024

(30) Foreign Application Priority Data

Nov. 11, 2021 (KR) ..... 10-2021-0155183
May 18, 2022 (KR) ..... 10-2022-0060940

(51) Int. Cl.
*A24F 40/51* (2020.01)
*A24F 40/20* (2020.01)
(Continued)

(52) U.S. Cl.
CPC ..... *A24F 40/51* (2020.01); *A24F 40/20* (2020.01); *A24F 40/465* (2020.01); *A24F 40/53* (2020.01); *A24F 40/57* (2020.01); *A24F 40/65* (2020.01)

(58) Field of Classification Search
CPC ..... A24F 40/51; A24F 40/20; A24F 40/50; A24D 1/20
See application file for complete search history.

(56) References Cited

U.S. PATENT DOCUMENTS

2015/0173124 A1* 6/2015 Qiu ..... A24F 40/60 131/328
2016/0022930 A1 1/2016 Greim et al.
(Continued)

FOREIGN PATENT DOCUMENTS

CN 209284327 U 8/2019
CN 112056626 A 12/2020
(Continued)

OTHER PUBLICATIONS

International Search Report for PCT/KR2022/017503 dated Feb. 21, 2023 (PCT/ISA/210).
(Continued)

*Primary Examiner* — Michael H. Wilson
*Assistant Examiner* — Stephanie Lynn Moore
(74) *Attorney, Agent, or Firm* — Sughrue Mion, PLLC

(57) ABSTRACT

An aerosol-generating device according to embodiments includes a first sensor configured to measure a temperature of a heating member for heating an aerosol generating material, a second sensor configured to detect a characteristic of the aerosol generating material, a switching module connected to the first sensor and the second sensor and to a shared sensor signal line connected to the heating member, and a controller configured to control the switching module
(Continued)

and receive a first sensor output signal from the first sensor or a second sensor output signal from the second sensor.

15 Claims, 4 Drawing Sheets

(51) Int. Cl.

| | |
|---|---|
| ***A24F 40/465*** | (2020.01) |
| ***A24F 40/53*** | (2020.01) |
| ***A24F 40/57*** | (2020.01) |
| ***A24F 40/65*** | (2020.01) |

(56) References Cited

U.S. PATENT DOCUMENTS

| | | | | |
|---|---|---|---|---|
| 2017/0108536 | A1 | 4/2017 | Hebiguchi | |
| 2017/0181223 | A1 | 6/2017 | Sur et al. | |
| 2018/0140008 | A1 | 5/2018 | Sur et al. | |
| 2020/0029625 | A1 | 1/2020 | Tygett | |
| 2020/0093185 | A1* | 3/2020 | Lim | A24F 40/53 |
| 2021/0015163 | A1 | 1/2021 | Mizuguchi et al. | |
| 2022/0117307 | A1* | 4/2022 | Abi Aoun | A24F 40/50 |
| 2022/0125110 | A1* | 4/2022 | Frake | A24F 40/20 |
| 2022/0183371 | A1 | 6/2022 | Blandino et al. | |
| 2022/0400768 | A1 | 12/2022 | Jung | |
| 2022/0408834 | A1 | 12/2022 | Kim et al. | |
| 2023/0346025 | A1* | 11/2023 | Jeong | H05B 3/42 |

FOREIGN PATENT DOCUMENTS

| | | | |
|---|---|---|---|
| CN | 113382646 | A | 9/2021 |
| EP | 3760062 | A1 | 1/2021 |
| EP | 4 319 487 | A1 | 2/2024 |
| JP | 2019-200106 | A | 11/2019 |
| JP | 2020-521438 | A | 7/2020 |
| JP | 6923771 | B1 | 8/2021 |
| KR | 10-2015-0129683 | A | 11/2015 |
| KR | 10-2020-0005160 | A | 1/2020 |
| KR | 10-2021-006088 | A | 1/2021 |
| KR | 10-2021-0092082 | A | 7/2021 |
| KR | 10-2274286 | B1 | 7/2021 |
| KR | 10-2021-0126582 | A | 10/2021 |
| KR | 10-2021-0132069 | A | 11/2021 |
| KR | 10-2021-0138547 | A | 11/2021 |
| WO | 2016/021500 | A1 | 2/2016 |
| WO | 2020/222530 | A1 | 11/2020 |
| WO | 2021/072660 | A1 | 4/2021 |
| WO | 2021/079323 | A1 | 4/2021 |
| WO | 2021/157841 | A1 | 8/2021 |
| WO | 2021/162224 | A1 | 8/2021 |
| WO | 2022/255700 | A1 | 12/2022 |
| WO | 2023/020966 | A1 | 2/2023 |
| WO | 2023/075380 | A1 | 5/2023 |

OTHER PUBLICATIONS

Written Opinion for PCT/KR2022/017503 dated Feb. 21, 2023 (PCT/ISA/237).

Korean Office Action dated Nov. 1, 2024 in Application No. 10-2022-0060940.

Extended European Search Report dated Sep. 18, 2024 in App. No. 22893166.3.

Chinese Office Action dated Apr. 14, 2026, issued in Chinese application No. 202280038556.2.

Communication dated Aug. 3, 2026, issued in European Application No. 22893166.3.

* cited by examiner

[Fig. 1]
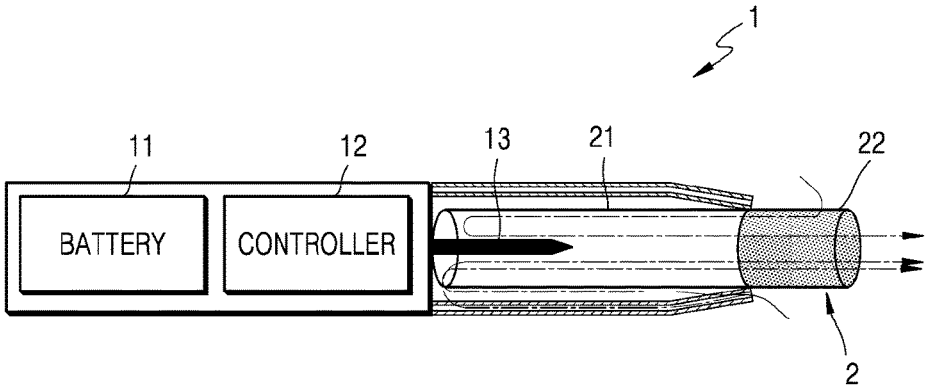
[Fig. 2]
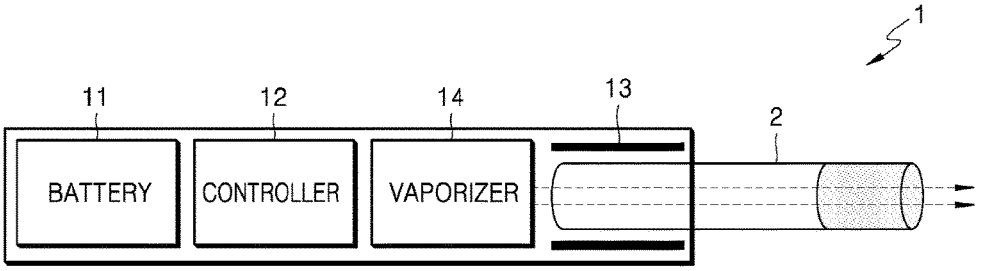
[Fig. 3]
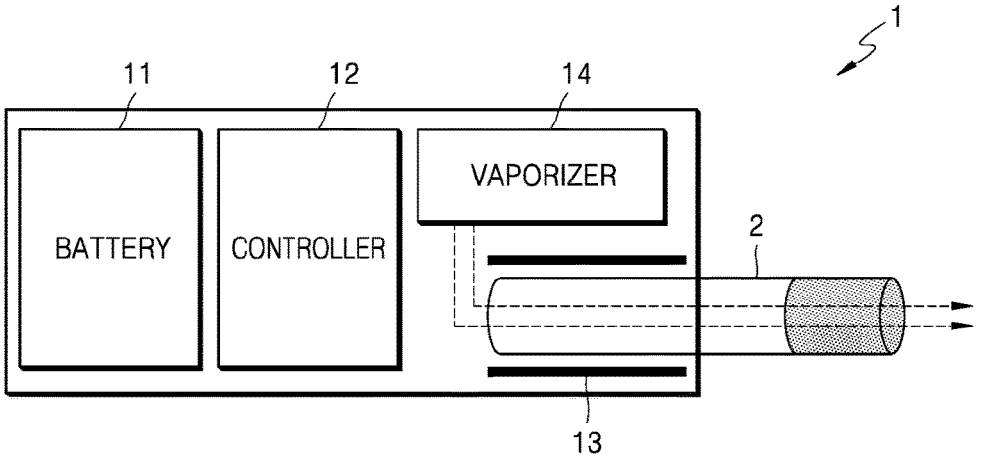
[Fig. 4]
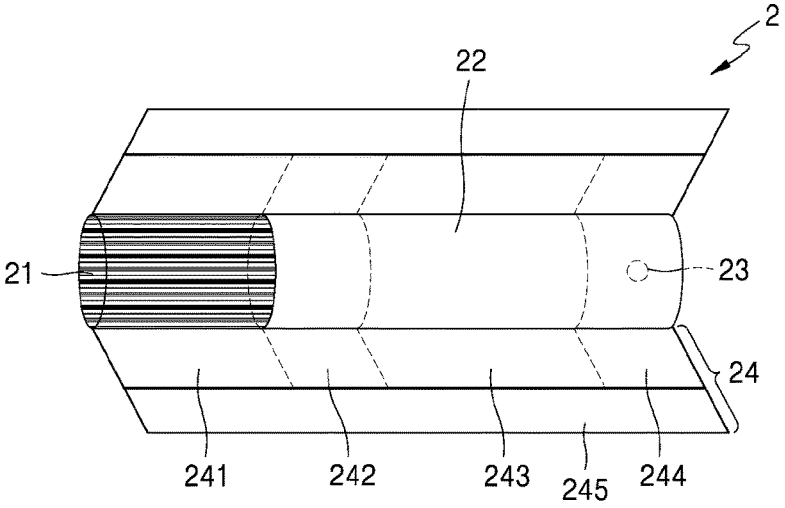

[Fig. 5]
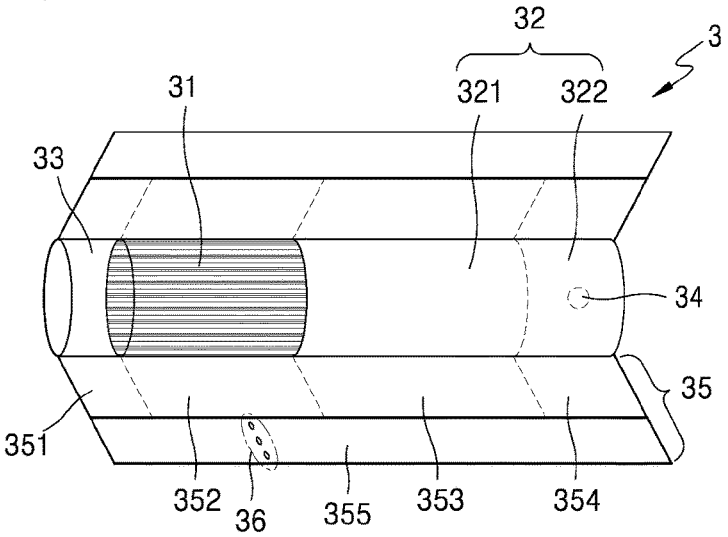
[Fig. 6]
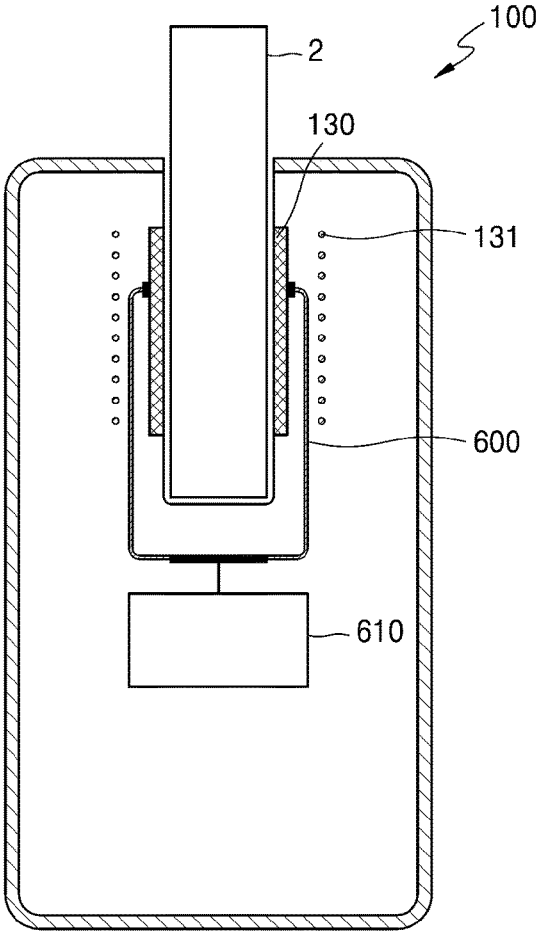
[Fig. 7]
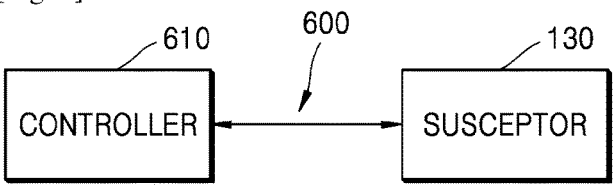

[Fig. 8]
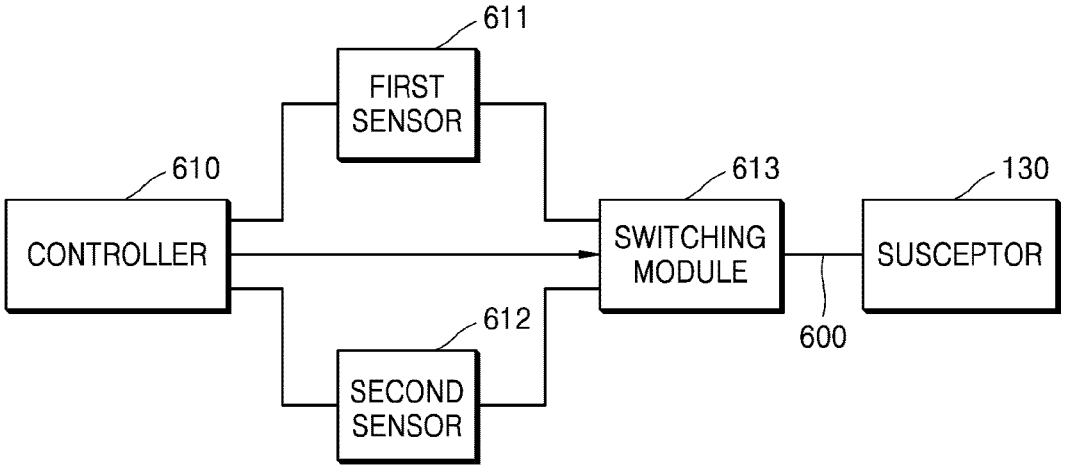
[Fig. 9]
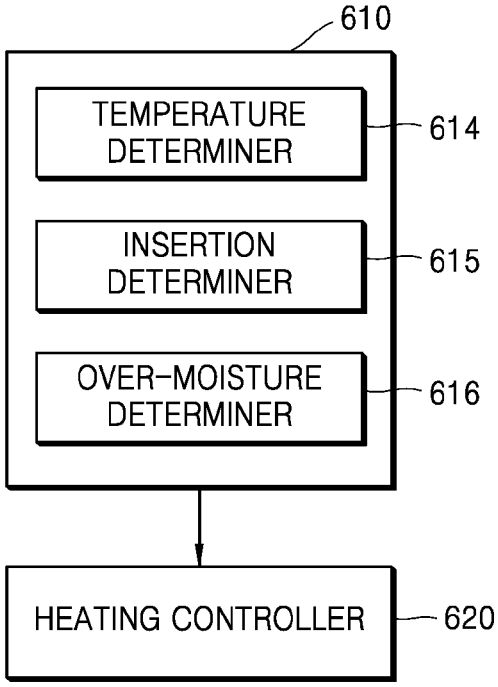

[Fig. 10]
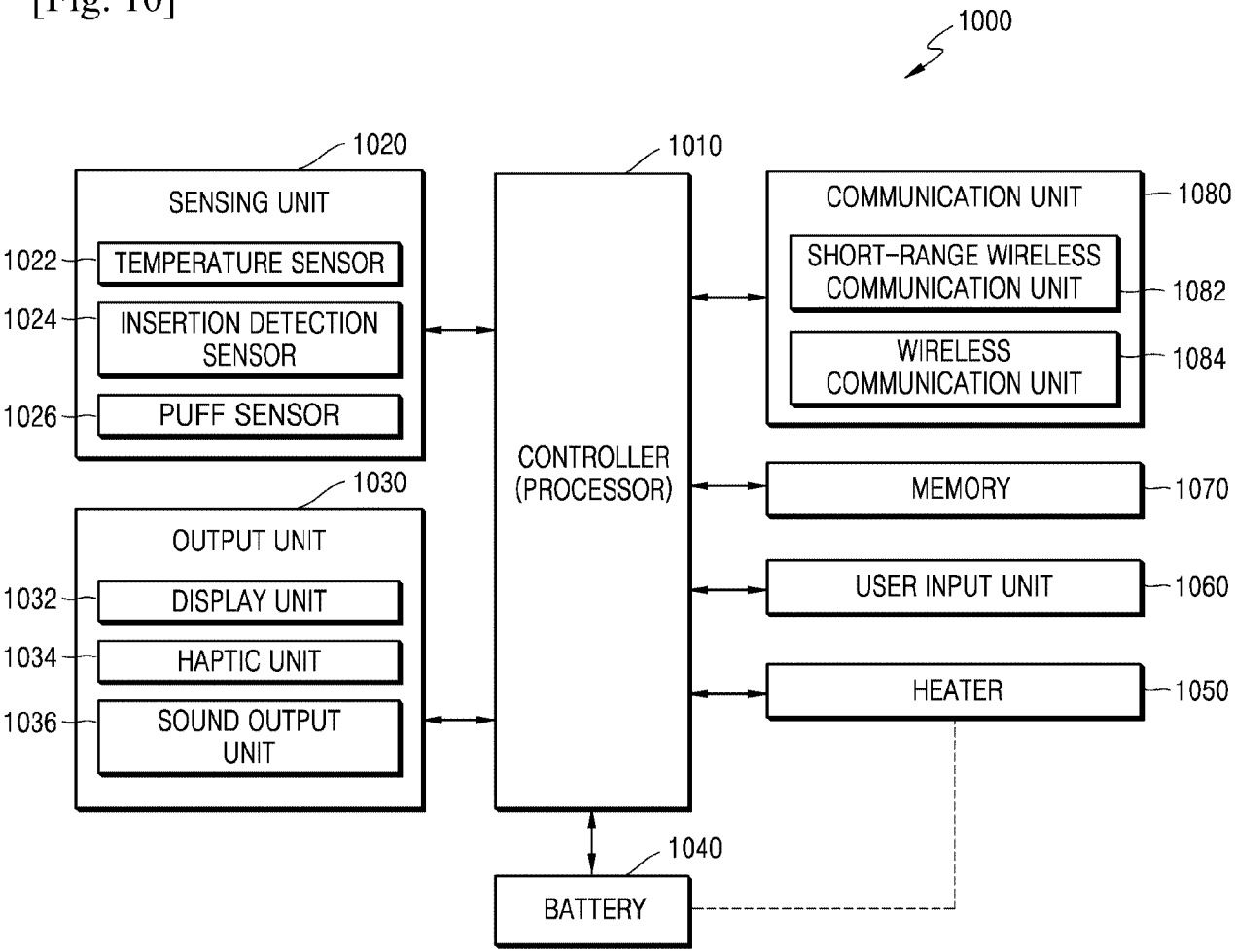

AEROSOL-GENERATING DEVICE

CROSS REFERENCE TO RELATED APPLICATIONS

This application is a National Stage of International Application No. PCT/KR2022/017503 filed Nov. 9, 2022, claiming priorities based on Korean Patent Application No. 10-2021-0155183 filed Nov. 11, 2021 and Korean Patent Application No. 10-2022-0060940 filed May 18, 2022.

TECHNICAL FIELD

The disclosure relates to an aerosol-generating device.

BACKGROUND ART

In recent years, there has been an increasing demand for an alternative method that overcomes the disadvantages of existing cigarettes. For example, there has been a growing demand for a system that generates an aerosol by heating a cigarette or an aerosol generating material by using an aerosol-generating device, rather than by burning a cigarette.

It is necessary for the aerosol-generating device to set a target temperature for heating an aerosol-generating article, and to confirm whether a heating temperature reaches the target temperature. To this end, the aerosol-generating device includes a temperature sensor or thermocouple that measures the temperature of a heater or heating element which heats an aerosol-generating article.

DISCLOSURE OF INVENTION

Technical Problem

Recent aerosol-generating devices have been equipped with various sensors to precisely control a heating temperature and improve user convenience. However, as many sensors are provided, there is a problem in that many physical sensing lines have to be arranged and designed.

Embodiments of the disclosure provide an aerosol-generating device capable of reducing manufacturing complexity and material cost by various sensors performing respective sensing operations through existing sensing lines for temperature sensing.

Embodiments of the disclosure provide an aerosol-generating device capable of operating a heating member through a separate temperature profile in the case of an over-moisture cigarette by sharing a thermocouple wire for controlling the temperature of the heating member with a capacitance sensor for identifying the over-moisture cigarette.

Technical problems to be solved by the embodiments of the disclosure are not limited to the above-described problems, and problems that are not mentioned will be clearly understood by those of ordinary skill in the art from the present specification and the accompanying drawings.

Solution to Problem

An aerosol-generating device according to an embodiment includes a first sensor configured to measure a temperature of a heating member for heating an aerosol generating material, a second sensor configured to detect a characteristic of the aerosol generating material, a switching module connected to the first sensor and the second sensor and to a shared sensor signal line connected to the heating member, and a controller configured to control the switching module and receive a first sensor output signal from the first sensor or a second sensor output signal from the second sensor.

Advantageous Effects of Invention

An aerosol-generating device according to various embodiments of the disclosure may reduce manufacturing complexity and material cost by various sensors performing respective sensing operations through existing sensing lines for temperature sensing.

An aerosol-generating device according to various embodiments of the disclosure may operate a heating member through a separate temperature profile in the case of an over-moisture cigarette by sharing a thermocouple wire for controlling the temperature of the heating member with a capacitance sensor for identifying the over-moisture cigarette, and thus may provide a user with an optimal amount of atomization and a feeling of smoking according to the characteristics of cigarettes.

However, the effects of the embodiments are not limited to the above-described effects, and effects not mentioned will be clearly understood by those of ordinary skill in the art to which the embodiments belong from the present specification and the accompanying drawings.

BRIEF DESCRIPTION OF DRAWINGS

FIGS. 1 to 3 are diagrams illustrating examples in which a cigarette is inserted into an aerosol-generating device according to an embodiment.

FIGS. 4 and 5 are diagrams illustrating examples of a cigarette according to an embodiment.

FIG. 6 is a schematic block diagram of an aerosol-generating device according to an embodiment.

FIG. 7 is a schematic diagram illustrating a connection between a controller and a susceptor shown in FIG. 6.

FIG. 8 is a detailed schematic diagram of an aerosol-generating device according to another embodiment.

FIG. 9 is a schematic diagram illustrating a controller shown in FIG. 8 and a heating controller.

FIG. 10 is a block diagram of an aerosol-generating device according to another embodiment.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1 through 3 are diagrams showing examples in which a cigarette is inserted into an aerosol-generating device.

Referring to FIG. 1, the aerosol-generating device 1 may include a battery 11, a controller 12, and a heater 13. Referring to FIGS. 2 and 3, the aerosol-generating device 1 may further include a vaporizer 14. Also, the cigarette 2 may be inserted into an inner space of the aerosol-generating device 1.

FIGS. 1 through 3 illustrate components of the aerosol-generating device 1, which are related to the present embodiment. Therefore, it will be understood by one of ordinary skill in the art related to the present embodiment that other general-purpose components may be further included in the aerosol-generating device 1, in addition to the components illustrated in FIGS. 1 through 3.

Also, FIGS. 2 and 3 illustrate that the aerosol-generating device 1 includes the heater 13. However, as necessary, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol-generating device 1 is not limited to the structures illustrated in FIGS. 1 through 3. In other words, according to the design of the aerosol-generating device 1, the battery 11, the controller 12, the heater 13, and the vaporizer 14 may be differently arranged.

When the cigarette 2 is inserted into the aerosol-generating device 1, the aerosol-generating device 1 may operate the heater 13 and/or the vaporizer 14 to generate aerosol from the cigarette 2 and/or the vaporizer 14. The aerosol generated by the heater 13 and/or the vaporizer 14 is delivered to a user by passing through the cigarette 2.

As necessary, even when the cigarette 2 is not inserted into the aerosol-generating device 1, the aerosol-generating device 1 may heat the heater 13.

The battery 11 may supply power to be used for the aerosol-generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol-generating device 1.

The controller 12 may generally control operations of the aerosol-generating device 1. In detail, the controller 12 may control not only operations of the battery 11, the heater 13, and the vaporizer 14, but also operations of other components included in the aerosol-generating device 1. Also, the controller 12 may check a state of each of the components of the aerosol-generating device 1 to determine whether or not the aerosol-generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette is inserted into the aerosol-generating device 1, the heater 13 may be located outside the cigarette. Thus, the heated heater 13 may increase a temperature of an aerosol generating material in the cigarette.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol-generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol-generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol-generating device 1 and the air flow passage may be configured such that the aerosol generated via the vaporizer 14 passes through the cigarette to be delivered to the user.

For example, the vaporizer 14 may include a liquid storage, a liquid delivery element, and a heating element, but it is not limited thereto. For example, the liquid storage, the liquid delivery element, and the heating element may be included in the aerosol-generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user.

Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol-generating device 1 may further include general-purpose components in addition to the battery 11, the controller 12, the heater 13, and the vaporizer 14. For example, the aerosol-generating device 1 may include a display capable of outputting visual information and/or a motor for outputting haptic information. Also, the aerosol-generating device 1 may include at least one sensor (a puff detecting sensor, a temperature detecting sensor, a cigarette insertion detecting sensor, etc.). Also, the aerosol-generating device 1 may be formed as a structure that, even when the cigarette 2 is inserted into the aerosol-generating device 1, may introduce external air or discharge internal air.

Although not illustrated in FIGS. 1 through 3, the aerosol-generating device 1 and an additional cradle may form together a system. For example, the cradle may be used to charge the battery 11 of the aerosol-generating device 1. Alternatively, the heater 13 may be heated when the cradle and the aerosol-generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol-generating device 1, and the second portion may be exposed to the outside. Alternatively, only a portion of the first portion may be inserted into the aerosol-generating device 1, or the entire first portion and a portion of the second portion may be inserted into the aerosol-generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol-generating device 1. For example, opening and closing of the air passage and/or a size of the air passage formed in the aerosol-generating device 1 may be adjusted by the user. Accordingly, the amount and the quality of smoking may be adjusted by the user. As another example, the external air may flow into the cigarette 2 through at least one hole formed in a surface of the cigarette 2.

Hereinafter, examples of the cigarette 2 will be described with reference to FIGS. 4 and 5.

FIGS. 4 and 5 illustrate examples of a cigarette.

Referring to FIG. 4, the cigarette 2 may include a tobacco rod 21 and a filter rod 22. The first portion described above with reference to FIGS. 1 through 3 may include the tobacco rod 21, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, according to necessity, the filter rod 22 may further include at least one segment configured to perform other functions.

The diameter of the cigarette 2 may be within the range of about 5 mm to about 9 mm and the length of the cigarette 2 may be about 48 mm. However, the disclosure is not limited thereto. For example, the length of the tobacco rod 21 may be about 12 mm, the length of the first segment of the filter rod 22 may be about 10 mm, the length of the second segment of the filter rod 22 may be about 14 mm, and the length of the third segment of the filter rod 22 may be about 12 mm. However, disclosure is not limited thereto.

The cigarette 2 may be packaged via at least one wrapper 24. The wrapper 24 may have at least one hole through which external air may be introduced or internal air may be discharged. For example, the cigarette 2 may be packaged via one wrapper 24. As another example, the cigarette 2 may be doubly packaged via at least two wrappers 24. For example, the tobacco rod 21 may be packaged via a first wrapper 241, and the filter rod 22 may be packaged via second wrappers 242, 243, and 244. Also, the entire cigarette 2 may be packaged via a single wrapper 245. When the filter rod 22 includes a plurality of segments, each segment may be packaged via each of the second wrappers 242, 243, and 244.

The first wrapper 241 and the second wrapper 242 may each include general filter wrapping paper. For example, the first wrapper 241 and the second wrapper 242 may each include porous wrapping paper or non-porous wrapping paper. In addition, the first wrapper 241 and the second wrapper 242 may each include paper having oil resistance and/or an aluminum laminate packaging material.

The third wrapper 243 may include hard wrapping paper. For example, the basis weight of the third wrapper 243 may be in the range of about 88 $g/m^2$ to about 96 $g/m^2$, or in the range of about 90 $g/m^2$ to about 94 $g/m^2$. In addition, the thickness of the third wrapper 243 may be in the range of about 120 um to about 130 um, for example, 125 um.

The fourth wrapper 244 may include oil-resistant hard wrapping paper. For example, the basis weight of the fourth wrapper 244 may be in the range of about 88 $g/m^2$ to about 96 $g/m^2$, or in the range of about 90 $g/m^2$ to about 94 $g/m^2$. In addition, the thickness of the fourth wrapper 244 may be in the range of about 120 um to about 130 um, for example, 125 um.

The fifth wrapper 245 may include sterile paper (MFW). Here, the sterile paper (MFW) refers to a paper specially prepared so that tensile strength, water resistance, smoothness, etc. thereof are further improved compared to those of general paper. For example, the basis weight of the fifth wrapper 245 may be in the range of about 57 $g/m^2$ to about 63 g/m$^2$, for example, 60 g/m$^2$. In addition, the thickness of the fifth wrapper 245 may be in the range of about 64 um to about 70 um, for example, 67 um.

A certain material may be internally added to the fifth wrapper 245. Here, an example of the certain material may include silicon, but is not limited thereto. For example, silicon has characteristics, such as heat resistance with little change with temperature, resistance to oxidation, resistance to various chemicals, water repellency against water, or electrical insulation. However, even though the certain material is not silicon, any material having the characteristics described above may be applied to (or coated on) the fifth wrapper 245 without limitation.

The fifth wrapper 245 may prevent the cigarette 2 from burning. For example, when the tobacco rod 21 is heated by the heater 13, there is a possibility that the cigarette 2 is burned. Specifically, when the temperature rises above the ignition point of any one of the materials included in the tobacco rod 21, the cigarette 2 may be burned. Even in this case, because the fifth wrapper 245 includes a non-combustible material, a burning phenomenon of the cigarette 2 may be prevented.

In addition, the fifth wrapper 245 may prevent a holder 1 from being contaminated by substances generated in the cigarette 2. By a user's puff, liquid substances may be generated in the cigarette 2. For example, as an aerosol generated in the cigarette 2 is cooled by the outside air, liquid substances (e.g., moisture, etc.) may be generated. As the fifth wrapper 245 wraps the cigarette 2, the liquid substances generated in the cigarette 2 may be prevented from leaking out of the cigarette 2.

The tobacco rod 21 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 21 may be formed in various ways. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod 21 may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

The first segment of the filter rod 22 may include a cellulose acetate filter. For example, the first segment may include a tube-shaped structure including a hollow therein. When the heater 13 is inserted by the first segment, the inner material of the tobacco rod 21 may be prevented from being pushed back, and a cooling effect of the aerosol may occur. The diameter of the hollow included in the first segment may be an appropriate diameter within the range of about 2 mm to about 4.5 mm, but is not limited thereto.

The length of the first segment may be an appropriate length within the range of about 4 mm to about 30 mm, but is not limited thereto. For example, the length of the first segment may be 10 mm, but is not limited thereto.

The hardness of the first segment may be adjusted by adjusting the content of a plasticizer in the manufacture of the first segment. In addition, the first segment may be manufactured by inserting a structure, such as a film or a tube including the same material or different materials, inside the first segment (e.g., into the hollow).

The second segment of the filter rod 22 cools the aerosol generated as the heater 13 heats the tobacco rod 21. Thus, a user may inhale the aerosol cooled to a suitable temperature.

The length or diameter of the second segment may be variously determined according to the shape of the cigarette 2. For example, the length of the second segment may be appropriately determined within the range of about 7 mm to about 20 mm. For example, the length of the second segment may be about 14 mm, but is not limited thereto.

The second segment may be fabricated by weaving polymer fibers. In this case, a flavored liquid may be applied to fibers made of polymer. Alternatively, the second segment may be fabricated by weaving a fiber to which a flavored liquid is applied and a fiber made of a polymer together. Alternatively, the second segment may be formed by a crimped polymer sheet.

For example, the polymer may include a material selected from the group consisting of polyethylene (PE), polypropylene (PP), polyvinyl chloride (PVC), polyethylene terephthalate (PET), polylactic acid (PLA), cellulose acetate (CA), and aluminum foil.

As the second segment is formed by a woven polymer fiber or crimped polymer sheet, the second segment may include a single channel or a plurality of channels extending in a longitudinal direction thereof. Here, the channel refers to a passage through which a gas (e.g., air or aerosol) passes.

For example, the second segment formed by the crimped polymer sheet may be formed from a material having a thickness between about 5 μm and about 300 μm, such as between about 10 μm and about 250 μm. Also, the total surface area of the second segment may be between about 300 mm$^2$/mm and about 1000 mm$^2$/mm. Furthermore, an aerosol cooling element may be formed from a material having a specific surface area between about 10 mm$^2$/mg and about 100 mm$^2$/mg.

The second segment may include a thread containing a volatile flavor ingredient. Here, the volatile flavor ingredient may be menthol, but is not limited thereto. For example, the thread may be filled with a sufficient amount of menthol to provide 1.5 mg or more of menthol to the second segment.

The third segment of the filter rod 22 may include a cellulose acetate filter. The length of the third segment may be appropriately determined within the range of about 4 mm to about 20 mm. For example, the length of the third segment may be about 12 mm, but is not limited thereto.

The third segment may be fabricated such that flavor is generated by spraying a flavored liquid on the third segment in the process of fabricating the third segment. Alternatively, a separate fiber to which a flavored liquid is applied may be inserted into the third segment. The aerosol generated by the tobacco rod 21 is cooled as the aerosol passes through the second segment of the filter rod 22, and the cooled aerosol is delivered to a user through the third segment. Accordingly, when a flavoring element is added to the third segment, an effect of enhancing the durability of a flavor delivered to the user may occur.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

Referring to FIG. 5, the cigarette 2 may further include a front-end filter 33 that is a front-end plug. The front-end filter 33 may be located on a side of the tobacco rod 21, the side facing the filter rod 22. The front-end filter 33 may prevent the tobacco rod 31 from being detached outwards and prevent a liquefied aerosol from flowing into the aerosol-generating device 1 (FIGS. 1 through 3) from the tobacco rod 21, during smoking.

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

The total length and diameter of the cigarette 3 may correspond to the total length and diameter of the cigarette 2 of FIG. 4. For example, the length of the front-end filter 33 may be about 7 mm, the length of the tobacco rod 31 may be about 15 mm, the length of the first segment 321 may be about 12 mm, and the length of the first segment 322 may be about 14 mm, but the embodiments are not limited thereto.

The cigarette 3 may be packaged via at least one wrapper 35. The wrapper 35 may have at least one hole through which external air may be introduced or internal air may be discharged. For example, the front-end filter 33 may be packaged via a first wrapper 351, the filter rod 31 may be packaged via a second wrapper 352, the first segment 321 may be packaged via a third wrapper 353, and the second segment 322 may be packaged via a fourth wrapper 354. Additionally, a whole part of the cigarette 3 may be packaged by a fifth wrapper 355.

Also, the fifth wrapper 355 may have at least one through hole 36. For example, the through hole 36 may be formed at a portion of the fifth wrapper 355 surrounding the tobacco rod 31. The through hole 36 may perform a function of transmitting heat generated by the heater 31 shown in FIGS. 2 and 3 to the inside of the tobacco rod 31.

Also, the second segment 322 may include at least one capsule 34. Here, the capsule 34 may perform a function of generating a flavor or another function of generating aerosol. For example, the capsule 34 may have a configuration in which a liquid containing a flavoring material is wrapped with a film. For example, the capsule 34 may have a spherical or cylindrical shape, but is not limited thereto.

The first wrapper 351 may include general filter wrapping paper to which a metal foil such as an aluminum foil is coupled. For example, the total thickness of the first wrapper 351 may be in the range of about 45 um to about 55 um, for example, 50.3 um. In addition, the thickness of the metal foil of the first wrapper 351 may be in the range of about 6 um to about 7 um, for example, 6.3 um. In addition, the basis weight of the first wrapper 351 may be in the range of about 50 g/m$^2$ to about 55 g/m$^2$, for example, 53 g/m$^2$.

The second wrapper 352 and the third wrapper 353 may each include general filter wrapping paper. For example, the second wrapper 352 and the third wrapper 353 may each include porous wrapping paper or non-porous wrapping paper.

For example, the porosity of the second wrapper 352 may be 35,000 CU, but is not limited thereto. In addition, the thickness of the second wrapper 352 may be in the range of about 70 um to about 80 um, for example, 78 um. In addition, the basis weight of the second wrapper 352 may be in the range of about 20 g/m$^2$ to about 25 g/m$^2$, for example, 23.5 g/m$^2$.

For example, the porosity of the third wrapper 353 may be 24,000 CU, but is not limited thereto. In addition, the thickness of the third wrapper 353 may be in the range of about 60 um to about 70 um, for example, 68 um. In addition, the basis weight of the third wrapper 353 may be in the range of about 20 g/m$^2$ to about 25 g/m$^2$, for example, 21 g/m$^2$.

The fourth wrapper 354 may include PLA laminated paper. Here, the PLA laminated paper refers to a three-ply paper including a paper layer, a PLA layer, and a paper layer. For example, the thickness of the fourth wrapper 354 may be in the range of about 100 um to about 120 um, for example, 110 um. In addition, the basis weight of the fourth wrapper 354 may be in the range of about 80 g/m$^2$ to about 100 g/m$^2$, for example, 88 g/m$^2$.

The fifth wrapper 355 may include sterilized paper (MFW). Here, the sterile paper (MFW) refers to a paper specially prepared so that tensile strength, water resistance, smoothness, etc. thereof are further improved compared to those of general paper. For example, the basis weight of the fifth wrapper 355 may be in the range of about 57 g/m$^2$ to about 63 g/m$^2$, for example, 60 g/m$^2$. In addition, the thickness of the fifth wrapper 355 may be in the range of about 64 um to about 70 um, for example, 67 um.

A certain material may be internally added to the fifth wrapper 355. Here, an example of the certain material may include, but is not limited thereto. For example, silicon has characteristics, such as heat resistance with little change with temperature, resistance to oxidation, resistance to various chemicals, water repellency against water, or electrical insulation. However, even though the certain material is not silicon, any material having the characteristics described above may be applied to (or coated on) the fifth wrapper 355 without limitation.

The shear plug 33 may include cellulose acetate. As an example, the front-end filter 33 may be fabricated by adding a plasticizer (e.g., triacetin) to a cellulose acetate tow. The mono denier of a filament constituting the cellulose acetate tow may be in the range of about 1.0 to about 10.0, or in the range of about 4.0 to about 6.0. More specifically, the mono denier of the filament of the front-end filter 33 may be 5.0. In addition, the cross-section of the filament constituting the front-end filter 33 may have a Y-shape. The total denier of the front-end filter 33 may be in the range of about 20,000 to about 30,000, preferably in the range of about 25,000 to about 30,000. For example, the total denier of the front-end filter 33 may be 28,000.

In addition, if necessary, the front-end filter 33 may include at least one channel, and the cross-section of the channel may have various shapes.

The tobacco rod 31 may correspond to the tobacco rod 21 described above with reference to FIG. 4. Therefore, a detailed description of the tobacco rod 31 is omitted below.

The first segment 321 may include cellulose acetate. For example, the first segment may include a tube-shaped structure including a hollow therein. The first segment 321 may be fabricated by adding a plasticizer (e.g., triacetin) to the cellulose acetate tow. For example, the mono denier and total denier of the first segment 321 may be the same as the mono denier and total denier of the front-end filter 33.

The second segment 322 may include cellulose acetate. The mono denier of a filament constituting the second segment 322 may be in the range of about 1.0 to about 10.0, or in the range of about 8.0 to about 10.0. For example, the mono denier of the filament of the second segment 322 may be 9.0. In addition, the cross-section of the filament of the second segment 322 may have a Y-shape. The total denier of the second segment 322 may be in the range of about 20,000 to about 30,000, for example, 25,000.

FIG. 6 is a schematic diagram of an aerosol-generating device 100 according to an embodiment, and FIG. 7 is a schematic diagram illustrating a connection between a controller and a susceptor shown in FIG. 6. The aerosol-generating device 100 according to an embodiment may generate an aerosol by heating a cigarette 2 accommodated in the aerosol-generating device 100 by using an induction heating method. For example, the aerosol-generating device 100 may generate a variable magnetic field by supplying power to an induction coil 131. In this case, at least a portion of the cigarette 2 may be heated through a heating member 130 heated by the variable magnetic field, and an aerosol may be generated as the cigarette 2 is heated. Here, although the aerosol-generating device 100 is described as an aerosol-generating device using an induction heating method, the disclosure is not limited thereto, and embodiments may be equally applied to an aerosol-generating device using a resistance heater method.

Referring to FIGS. 6 and 7, the aerosol-generating device 100 includes the heating member 130 for heating the cigarette 2 inserted therein, and a coil 131 for inducing a variable magnetic field in the heating member 130 to heat a position corresponding to an aerosol-generating article of the cigarette 2.

In an embodiment, the heating member 130 may be a susceptor. Hereinafter, the heating member 130 and the susceptor will be interchangeably used. That is, hereinafter, the heating member 130 may be referred to as a susceptor, and vice versa. The susceptor 130 may surround at least a portion of the outer surface of the cigarette 2 accommodated in the aerosol-generating device 100. For example, the susceptor 130 may surround at least portions of a portion including the aerosol generating material and a portion including a tobacco material.

In an embodiment, the induction coil 131 may be disposed to surround the outer circumferential surface of the susceptor 130, and may generate a variable magnetic field in response to power being supplied from a battery. In an embodiment, in the induction coil 131, an alternating current (AC) value and a frequency value capable of heating the susceptor 130 may be preset. For example, in the induction coil 131, the AC current value may be set in a range of about 120 mA to 140 mA and the frequency value may be set in a range of about 130 KHz to 150 KHz. However, the AC current value and the frequency value of the induction coil 131 are not limited thereto, and may be variously changed depending on the material, thickness, or shape of the susceptor 130.

A sensing line 600 or a wire for measuring a temperature is connected to both outer sides of the susceptor 130. A controller 610 applies a sensor control signal, for example, a voltage signal or a current signal, through the sensing line 600, and reads a sensor output signal, for example, a resistance value or a capacitance value, measured by the susceptor 130.

In an embodiment, the aerosol-generating device 100 includes a first sensor for measuring the temperature of the heating member 130 for heating the aerosol generating material, and a second sensor for detecting characteristics of the aerosol generating material. Here, the first sensor may be a contact temperature sensor, such as a thermocouple, a resistance temperature detector (RTD), a thermistor, or a temperature label. The second sensor may be a capacitance sensor that detects characteristics of the cigarette 2 accommodated in the susceptor 130. The second sensor may detect whether the cigarette 2 accommodated in the susceptor 130 is an over-moisture cigarette. In addition, the second sensor may detect whether a cigarette 2 is accommodated or inserted into the susceptor 130. The first and second sensors are described below with reference to FIG. 8.

In an embodiment, the aerosol-generating device 100 includes a switching module 613 connected to the first sensor 611 and the second sensor 612 and to the shared sensor signal line 600 connected to the heating member 130. The controller 610 may switch the switching module to perform temperature measurement by the first sensor or to perform detection of characteristics of an aerosol-generating article (e.g., cigarette 2) by the second sensor. That is, the first sensor 611 and the second sensor 612 perform their respective sensing operations (e.g., temperature measuring and characteristics detection) based on information about the heating member 130 that is collected via the shared sensor signal line 600 connected to the heating member 130.

Also, in an embodiment, the aerosol-generating device 100 may further include a third sensor for detecting whether the cigarette 2 is inserted into the susceptor 130. Here, the third sensor may be an inductance sensor, and the coil 131 shown in FIG. 6 may function as the third sensor. In addition, when the second sensor is a capacitance sensor, the second sensor may perform a function of detecting whether the cigarette 2 is inserted into the susceptor 130.

The controller 610 may output a second sensor control signal to the second sensor by switching the switching module in response to a third sensor output signal from the third sensor. In an embodiment, when a cigarette is inserted into the susceptor 130, sensor power consumption may be reduced by driving the second sensor for detecting the characteristics of the cigarette.

FIG. 8 is a detailed schematic diagram of an aerosol-generating device according to another embodiment.

Referring to FIG. 8, the aerosol-generating device includes a controller 610, a first sensor 611, a second sensor 612, a switching module 613, and a susceptor 130.

The controller 610, the first sensor 611, the second sensor 612, and the switching module 613 may be arranged on a main printed circuit board (PCB). Alternatively, the controller 610, the first sensor 611, and the second sensor 612 may be arranged on the main PCB, and the switching module 613 may be separate from the main PCB. The first sensor 611 and the second sensor 612 may be controlled by one sensor controller, or may be controlled by their respective sensor controllers. In an embodiment, the first sensor 611 and the second sensor 612 may be included as a function module in the controller 610 or a microcontroller unit (MCU).

The switching module 613 is connected to the first sensor 611 and the second sensor 612. Also, the switching module 613 is connected to a shared sensor signal line connected to the susceptor 130. The switching module 613 may be a single pole double throw (SPDT) switch. The switching module 613 may connect the first sensor 611 to the susceptor 130 or connect the second sensor 612 to the susceptor 130, according to a switching signal of the controller 610.

The controller 610 may switch the switching module 613 and output the second sensor control signal, for example, a voltage or current signal, to the second sensor 612 to thereby detect the characteristics of an aerosol generating material contained in the cigarette accommodated in the susceptor 130. In this case, the first sensor 611 and the susceptor 130 are not physically connected to each other. In an embodiment where the second sensor 612 is a capacitance sensor, an electric field may be formed between the susceptor 130 and an inserted cigarette according to a voltage or current signal applied to the outside of the susceptor 130, and when an over-moisture cigarette is inserted, an increase in moisture or a change in capacitance may be detected. Here, an over-moisture state (i.e., an excessive moisture state) may refer to a state in which the cigarette 2 contains moisture of about 15 wt % or more with respect to the total weight of the aerosol generating material of the cigarette 2. Accordingly, when the value of the detected capacitance is greater than a reference capacitance value corresponding to 15 wt %, it may be determined that the cigarette 2 is an over-moisture cigarette. However, the amount of moisture for determining the state (e.g., a general state or an over-moisture state) of the aerosol-generating article is not limited thereto, and may be variously changed depending on the designs of manufacturers.

When the cigarette 2 accommodated in the susceptor 130 is not an over-moisture cigarette, the controller 610 controls the cigarette 2 to be heated according to a first heating profile. On the other hand, when the cigarette 2 accommodated in the susceptor 130 is an over-moisture cigarette, the controller 610 controls the cigarette 2 to be heated according to a second heating profile that is different from the first heating profile. For example, the second heating profile may have a longer preheating period than the first heating profile.

After detecting the characteristics of the aerosol generating material through the second sensor 612, the controller 610 may switch the switching module 613, output a first sensor control signal to the first sensor 611, and measure the temperature of the susceptor 130. In this case, the second sensor 612 and the susceptor 130 are not physically connected to each other. In an embodiment where the first sensor 611 is a thermocouple, a current flows through a wire connected to both sides of the susceptor 130, and a change in temperature may be sensed from a change in resistance.

FIG. 9 is a schematic diagram illustrating the controller 610 shown in FIG. 8 and a heating controller 620.

Referring to FIGS. 8 and 9, the controller 610 includes a temperature determiner 614, an insertion determiner 615, and an over-moisture determiner 616. In addition, the controller 610 may control the heating controller 620, and the heating controller 620 may provide AC power to the coil 131 shown in FIG. 6.

The temperature determiner 614 determines the temperature of the susceptor 130 based on a first sensor output signal output from the first sensor 611.

The insertion determiner 615 determines whether the cigarette 2 is accommodated in the susceptor 130, based on a sensor output signal from the second sensor 612 or a separate third sensor (e.g., the coil 131 or inductance sensor shown in FIG. 6).

The over-moisture determiner 616 determines whether an aerosol generating article or an aerosol generating material in the aerosol generating article (e.g., the cigarette 2) accommodated in the susceptor 130 is in an over-moisture state, based on a second sensor output signal from the second sensor 612.

In an embodiment, when the insertion determiner 615 determines that the cigarette 2 is inserted, the controller 610 switches the switching module 613 and outputs the second sensor control signal to the second sensor 612. The over-moisture determiner 616 determines whether the cigarette 2 accommodated in the susceptor 130 is in an over-moisture state according to the second sensor output signal output from the second sensor 612.

The controller 610 loads a first heating profile or a second heating profile, stored in a memory (not shown), according to a determination result of the over-moisture determiner 616. The controller 610 outputs a heating control signal according to the first heating profile or the second heating profile to the heating controller 620, and the heating controller 620 provides AC power corresponding to the heating control signal to the coil 131.

In an embodiment, the controller 610 switches the switching module 613 after the determination of the over-moisture determiner 616 is finished, and outputs a first sensor control signal to the first sensor 611. The temperature determiner 614 receives the first sensor output signal from the first sensor 611, and determines the temperature of the susceptor 130 currently being heated.

When it is necessary to maintain or readjust the temperature of the susceptor 130 according to the temperature determined by the temperature determiner 614, the controller 610 may control the susceptor 130 to follow a target temperature on a heating profile through proportional-integral-differential (PID) control.

FIG. 10 is a block diagram of an aerosol-generating device 1000 according to another embodiment.

Referring to FIG. 10, the aerosol-generating device 1000 may include a controller 1010, a sensing unit 1020, an output unit 1030, a battery 1040, a heater 1050, a user input unit 1060, a memory 1070, a communication unit 1080. However, the internal structure of the aerosol-generating device 1000 is not limited to that shown in FIG. 6. That is, it will be understood by one of ordinary skill in the art that some of the components shown in FIG. 6 may be omitted or new components may be added according to the design of the aerosol-generating device 1000.

The sensing unit 1020 may sense a state of the aerosol-generating device 1000 or a state around the aerosol-generating device 1000, and transmit sensed information to the controller 1010. Based on the sensed information, the controller 1010 may control the aerosol-generating device 1000 to perform various functions, such as controlling an operation of the heater 1050, limiting smoking, determining whether an aerosol-generating article (e.g., a cigarette, a cartridge, or the like) is inserted, displaying a notification, or the like.

The sensing unit 1020 may include at least one of a temperature sensor 1022, an insertion detection sensor 1024, and a puff sensor 1026, but is not limited thereto.

The temperature sensor 1022 may sense a temperature at which the heater 1050 (or an aerosol generating material) is heated. The aerosol-generating device 1000 may include a separate temperature sensor for sensing the temperature of the heater 1050, or the heater 1050 may serve as a temperature sensor. Alternatively, the temperature sensor 1022 may also be arranged around the battery 1040 to monitor the temperature of the battery 1040. In an embodiment, the temperature sensor 1022 may measure the temperature of the heater 1050 before being heated.

In an embodiment, the temperature sensor 1022 may be a first sensor, and may be a thermocouple using a manner of measuring a change in resistance through a wire connected to the outside of the susceptor 130.

The insertion detection sensor 1024 may sense insertion and/or removal of an aerosol-generating article. For example, the insertion detection sensor 1024 may include at least one of a film sensor, a pressure sensor, an optical sensor, a resistive sensor, a capacitive sensor, an inductive sensor, and an infrared sensor, and may sense a signal change according to the insertion and/or removal of an aerosol-generating article. In an embodiment, the insertion detection sensor 1024 may be a second sensor that is a capacitance sensor or a third sensor that is an inductance sensor. In addition, the second sensor may determine the physical characteristics of a cigarette accommodated in the susceptor 130, that is, an over-moisture state. In an embodiment, the first sensor and the second sensor may share a physical sensing line (e.g., shared sensor signal line 600) connected to both sides of the susceptor 130.

The puff sensor 1026 may sense a user's puff based on various physical changes in an airflow passage or an airflow channel. For example, the puff sensor 1026 may sense a user's puff based on any one of a temperature change, a flow change, a voltage change, and a pressure change.

The sensing unit 1020 may include, in addition to the temperature sensor 1022, the insertion detection sensor 1024, and the puff sensor 1026 described above, at least one of a temperature/humidity sensor, a barometric pressure sensor, a magnetic sensor, an acceleration sensor, a gyroscope sensor, a location sensor (e.g., a global positioning system (GPS)), a proximity sensor, and a red-green-blue (RGB) sensor (illuminance sensor). Because a function of each of sensors may be intuitively inferred by one of ordinary skill in the art from the name of the sensor, a detailed description thereof may be omitted.

The output unit 1030 may output information on a state of the aerosol-generating device 1000 and provide the information to a user. The output unit 1030 may include at least one of a display unit 1032, a haptic unit 1034, and a sound output unit 1036, but is not limited thereto. When the display unit 1032 and a touch pad form a layered structure to form a touch screen, the display unit 1032 may also be used as an input device in addition to an output device.

The display unit 1032 may visually provide information about the aerosol-generating device 1000 to the user. For example, information about the aerosol-generating device 1000 may mean various pieces of information, such as a charging/discharging state of the battery 1040 of the aerosol-generating device 1000, a preheating state of the heater 1050, an insertion/removal state of an aerosol-generating article, or a state in which the use of the aerosol-generating device 1000 is restricted (e.g., sensing of an abnormal object), or the like, and the display unit 1032 may output the information to the outside. The display unit 1032 may be, for example, a liquid crystal display (LCD) panel, an organic light-emitting diode (OLED) display panel, or the like. In addition, the display unit 1032 may be in the form of a light-emitting diode (LED) device.

The haptic unit 1034 may tactilely provide information about the aerosol-generating device 1000 to the user by converting an electrical signal into a mechanical stimulus or an electrical stimulus. For example, the haptic unit 1034 may include a motor, a piezoelectric element, or an electrical stimulation device.

The sound output unit 1036 may audibly provide information about the aerosol-generating device 1000 to the user. For example, the sound output unit 1036 may convert an electrical signal into a sound signal and output the same to the outside.

The battery 1040 may supply power used to operate the aerosol-generating device 1000. The battery 1040 may supply power such that the heater 1050 may be heated. In addition, the battery 1040 may supply power required for operations of other components (e.g., the sensing unit 1020, the output unit 1030, the user input unit 1060, the memory 1070, and the communication unit 1080) in the aerosol-generating device 1000. The battery 1040 may be a rechargeable battery or a disposable battery. For example, the battery 1040 may be a lithium polymer (LiPoly) battery, but is not limited thereto.

The heater 1050 may receive power from the battery 1040 to heat an aerosol generating material. Although not illustrated in FIG. 10, the aerosol-generating device 1000 may further include a power conversion circuit (e.g., a direct current (DC)/DC converter) that converts power of the battery 1040 and supplies the same to the heater 1050. In addition, when the aerosol-generating device 1000 generates aerosols in an induction heating method, the aerosol-generating device 1000 may further include a DC/AC converter that converts DC power of the battery 1040 into AC power.

The controller 1010, the sensing unit 1020, the output unit 1030, the user input unit 1060, the memory 1070, and the communication unit 1080 may each receive power from the battery 1040 to perform a function. Although not illustrated in FIG. 10, the aerosol-generating device 1000 may further include a power conversion circuit that converts power of the battery 1040 to supply the power to respective components, for example, a low dropout (LDO) circuit, or a voltage regulator circuit.

In an embodiment, the heater 1050 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, nichrome, or the like, but is not limited thereto. In addition, the heater 1050 may be implemented by a metal wire, a metal plate on which an electrically conductive track is arranged, a ceramic heating element, or the like, but is not limited thereto.

In another embodiment, the heater 1050 may be a heater of an induction heating type. For example, the heater 1050 may include a susceptor that heats an aerosol generating material by generating heat through a magnetic field applied by a coil.

In an embodiment, the heater 1050 may include a plurality of heaters. For example, the heater 1050 may include a first heater for heating a cigarette and a second heater for heating a liquid composition.

The user input unit 1060 may receive information input from the user or may output information to the user. For example, the user input unit 1060 may include a key pad, a dome switch, a touch pad (a contact capacitive method, a pressure resistance film method, an infrared sensing method, a surface ultrasonic conduction method, an integral tension measurement method, a piezoelectric effect method, or the like), a jog wheel, a jog switch, or the like, but is not limited thereto. In addition, although not illustrated in FIG. 10, the aerosol-generating device 1000 may further include a connection interface, such as a universal serial bus (USB) interface, and may connect to other external devices through the connection interface, such as the USB interface, to transmit and receive information, or to charge the battery 1040.

The memory 1070 is a hardware component that stores various types of data processed by the aerosol-generating device 1000, and may store data processed and data to be processed by the controller 1010. The memory 1070 may include at least one type of storage medium from among a flash memory type, a hard disk type, a multimedia card micro type memory, a card-type memory (for example, secure digital (SD) or extreme digital (XD) memory, etc.), random access memory (RAM), static random access memory (SRAM), read-only memory (ROM), electrically erasable programmable read-only memory (EEPROM), programmable read-only memory (PROM), a magnetic memory, a magnetic disk, and an optical disk. The memory 1070 may store an operation time of the aerosol-generating device 1000, the maximum number of puffs, the current number of puffs, at least one temperature profile, data about a user's smoking pattern, etc. In an embodiment, the memory 1070 may store a plurality of temperature profiles.

The communication unit 1080 may include at least one component for communication with another electronic device. For example, the communication unit 1080 may include a short-range wireless communication unit 1082 and a wireless communication unit 1084.

The short-range wireless communication unit 1082 may include a Bluetooth communication unit, a Bluetooth Low Energy (BLE) communication unit, a near field communication unit, a wireless LAN (WLAN) (Wi-Fi) communication unit, a Zigbee communication unit, an infrared data association (IrDA) communication unit, a Wi-Fi Direct (WFD) communication unit, an ultra-wideband (UWB) communication unit, an Ant+ communication unit, or the like, but is not limited thereto.

The wireless communication unit 1084 may include a cellular network communication unit, an Internet communication unit, a computer network (e.g., local area network (LAN) or wide area network (WAN)) communication unit, or the like, but is not limited thereto. The wireless communication unit 1084 may also identify and authenticate the aerosol-generating device 1000 within a communication network by using subscriber information (e.g., International Mobile Subscriber Identifier (IMSI)).

The controller 1010 may control general operations of the aerosol-generating device 1000. In an embodiment, the controller 1010 may include at least one processor. The processor may be implemented as an array of a plurality of logic gates or may be implemented as a combination of a general-purpose microprocessor and a memory in which a program executable by the microprocessor is stored. It will be understood by one of ordinary skill in the art that the processor may be implemented in other forms of hardware.

The controller 1010 may control the temperature of the heater 1050 by controlling supply of power of the battery 1040 to the heater 1050. For example, the controller 1010 may control power supply by controlling switching of a switching element between the battery 1040 and the heater 1050. In another example, a direct heating circuit may also control power supply to the heater 1050 according to a control command of the controller 1010.

When the operation of the aerosol-generating device 1000 is started, the controller 1010 controls power supply to the heater 1050 according to a predetermined temperature profile or a predetermined preheating profile.

In an embodiment, the controller 1010 may control the power supply to the heater 1050 in a PID control method. That is, the controller 1010 may control the power supply to the heater 1050 in the PID control method so that the heater 1050 has a temperature corresponding to a set temperature profile. For example, the controller 1010 may supply power by adjusting a parameter Kp for proportional control, a parameter Ki for integral control, and a parameter Kd for differential control or adjusting at least one of these parameters, so that the temperature of the heater 1050 reaches a target temperature for a time corresponding to a temperature rise period according to a temperature profile.

The controller 1010 may analyze a result sensed by the sensing unit 1020 and control subsequent processes to be performed. For example, the controller 1010 may control power supplied to the heater 1050 to start or end an operation of the heater 1050 based on a result sensed by the sensing unit 1020. As another example, the controller 1010 may control, based on a result sensed by the sensing unit 1020, the amount of power supplied to the heater 1050 and the time the power is supplied, such that the heater 1050 may be heated to a certain temperature or maintained at an appropriate temperature.

The controller 1010 may control the output unit 1030 based on a result sensed by the sensing unit 1020. For example, when the number of puffs counted through the puff sensor 1026 reaches a preset number, the controller 1010 may notify the user that the aerosol-generating device 1000 will soon be terminated through at least one of the display unit 1032, the haptic unit 1034, and the sound output unit 1036.

In an embodiment, the controller 1010 may control a power supply time and/or a power supply amount for the heater 1050 according to the state of an aerosol-generating article sensed by the sensing unit 1020. For example, when the aerosol-generating article 15 is in an over-moisture state, the controller 1010 may control a power supply time for an induction coil, thereby increasing a preheating time compared to a case where the aerosol-generating article 15 is in a general state.

One embodiment may also be implemented in the form of a computer-readable recording medium including instructions executable by a computer, such as a program module executable by the computer. The computer-readable recording medium may be any available medium that can be accessed by a computer, including both volatile and non-volatile media, and both removable and non-removable media. In addition, the computer-readable recording medium may include both a computer storage medium and a communication medium. The computer storage medium includes all of volatile and nonvolatile media, and removable and non-removable media implemented by any method or technology for storage of information such as computer-readable instructions, data structures, program modules, or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by those of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol-generating device comprising:

a first sensor configured to measure a temperature of a heating member for heating an aerosol generating material;

a second sensor configured to detect a characteristic of the aerosol generating material;

a switch connected to the first sensor, the second sensor, and a shared sensor signal line connected to the heating member, wherein the switch is configured to connect the shared sensor signal line to either the first sensor or the second sensor based on a signal from a controller; and the controller configured to control a connection of the switch and receive, based on the connection of the switch, either a first sensor output signal from the first sensor or a second sensor output signal from the second sensor.

2. The aerosol-generating device of claim 1, wherein the heating member comprises a susceptor configured to heat the aerosol generating material in response to a variable magnetic field induced by a coil.

3. The aerosol-generating device of claim 2, wherein the shared sensor signal line is connected to an outside of the susceptor.

4. The aerosol-generating device of claim 1, wherein the first sensor comprises a thermocouple.

5. The aerosol-generating device of claim 1, wherein the second sensor comprises a capacitance sensor.

6. The aerosol-generating device of claim 1, wherein the second sensor is further configured to detect whether a cigarette comprising the aerosol generating material is inserted into the heating member.

7. The aerosol-generating device of claim 1, wherein the switch comprises a single pole double throw (SPDT) switch.

8. The aerosol-generating device of claim 1, further comprising a third sensor configured to detect whether a cigarette comprising the aerosol generating material is inserted into the heating member, wherein the third sensor comprises an inductance sensor.

9. The aerosol-generating device of claim 8, wherein the inductance sensor comprises a coil configured to induce a variable magnetic field in the heating member.

10. The aerosol-generating device of claim 8, wherein the controller is further configured to, in response to a third sensor output signal from the third sensor:

adjust the connection of the switch such that the controller is connected to the second sensor, and output a second sensor control signal to the second sensor.

11. The aerosol-generating device of claim 1, wherein the controller is further configured to;

adjust the connection of the switch such that the controller is connected to the second sensor, output a second sensor control signal to the second sensor, and determine whether a cigarette comprising the aerosol generating material is an over-moisture cigarette according to a second sensor output signal from the second sensor.

12. The aerosol-generating device of claim 11, wherein the controller is further configured to:

after determining whether the cigarette is the over-moisture cigarette, adjust the connection of the switch such that the controller is connected to the first sensor, and output a first sensor control signal to the first sensor.

13. The aerosol-generating device of claim 11, wherein the controller is further configured to control the temperature of the heating member according to a first heating profile when the cigarette is not the over-moisture cigarette.

14. The aerosol-generating device of claim 13, wherein the controller is further configured to control the temperature of the heating member according to a second heating profile different from the first heating profile when the cigarette is the over-moisture cigarette.

15. The aerosol-generating device of claim 1, wherein the first sensor and the second sensor are controlled by one sensor controller.

* * * * *